United States Patent [19]

DeCrescente et al.

[11] Patent Number: 4,895,201

[45] Date of Patent: Jan. 23, 1990

[54] OXIDATION RESISTANT SUPERALLOYS CONTAINING LOW SULFUR LEVELS

[75] Inventors: Michael A. DeCrescente, Wethersfield; Norman S. Bornstein, West Hartford; John G. Smeggil, Simsbury, all of Conn.

[73] Assignee: United Technologies Corporation, Hartford, Conn.

[21] Appl. No.: 70,489

[22] Filed: Jul. 7, 1987

[51] Int. Cl.[4] ..... B22D 1/00

[52] U.S. Cl. ..... 164/56.1; 164/122.1; 164/122.2; 75/82; 29/156.8 H; 29/156.8 P

[58] Field of Search ..... 29/156.8 B, 156.8 H, 29/156.8 P; 164/55.1, 56.1, 122, 122.1, 122.2; 75/82; 420/441, 442, 454

[56] References Cited

U.S. PATENT DOCUMENTS

| | | | |
|---|---|---|---|
| 2,406,582 | 8/1946 | Bieber et al. | 75/82 |
| 3,211,549 | 10/1965 | Kusaka | 75/134 |
| 3,218,156 | 11/1965 | Van der Sluis et al. | 75/49 |
| 3,784,374 | 1/1974 | Almand | 75/129 |
| 3,795,505 | 3/1974 | Corradini | 75/53 |
| 3,816,103 | 6/1974 | Link, Jr. et al. | 75/53 |
| 3,853,540 | 12/1974 | Schlatter et al. | 75/53 |
| 3,869,282 | 3/1975 | Curran et al. | 75/82 |
| 4,018,597 | 4/1977 | Staggers | 75/58 |
| 4,049,470 | 9/1977 | Burton | 148/3 |
| 4,084,960 | 4/1978 | Kay et al. | 75/58 |
| 4,161,400 | 7/1979 | Wilson et al. | 75/58 |
| 4,385,934 | 5/1983 | McGurty | 75/124 F |
| 4,397,683 | 8/1983 | Kay et al. | 75/58 |
| 4,484,946 | 11/1984 | Ototani | 75/58 |
| 4,507,149 | 3/1985 | Kay et al. | 75/58 |
| 4,530,720 | 7/1985 | Moroishi et al. | 75/128 A |
| 4,542,116 | 9/1985 | Bertolacini et al. | 502/65 |
| 4,578,113 | 3/1986 | Rana et al. | 75/124 |
| 4,721,540 | 1/1988 | Harris et al. | 148/404 |

OTHER PUBLICATIONS

Paul D. Merica et al., "The Malleability of Nickel", Transactions of the AIME, vol. 71, 1925, pp. 709–719.

Richard S. Cremisio et al., "Sulfur—Its Effects, Removal or Modification in Vacuum Melting", Third International Symposium on Electroslag and Other Special Melting Technology, Jun. 1971, Symposium Proceedings Part I, pp. 1–30.

D. P. Whittle et al., "Improvement in Properties: Additives in Oxidation Resistance", Philosophical Transactions of the Royal Society of London, Series A., vol. 295 (1980), pp. 309–329.

Y. Ikeda et al., "High Temperature Oxidation and Surface Segregation of Sulfur", Proceedings of the Third Japan Inst. of Metals, vol. 24, 1983, pp. 207–214.

R. A. Mulford, "Grain Boundary Segregation in Ni and Binary Ni Alloys Doped with Sulfur", Metallurgical Transactions A, vol. 14A, May 1983, pp. 865–870.

A. W. Funkenbusch et al., "Reactive Element—Sulfur Interaction and Oxide Scale Adherence", Metallurgical Transactions A, vol. 16A, Jun. 1985, pp. 1164–1166.

J. G. Smeggil et al., "The Use of Ion Implantation Techniques to Study Protective Oxide Scale Adherence Effects", J. Vac. Sci. Technol. A, vol. 3, No. 6, Nov/-Dec 1985, pp. 2569–2573.

J. G. Smeggil et al., "A Relationship Between Indigenous Impurity Elements and Protective Oxide Scale Adherence Characteristics", Metallurgical Transactions A, vol. 17A, Jun. 1986, pp. 923–932.

J. G. Smeggil, A. W. Funkenbusch, "A Study of Adherent Oxide Scales", May 1985, pp. 1, 8–11.

A. W. Funkenbusch, J. G. Smeggil, "A Study of Adherent Oxide Formation", Oct. 1983, pp. 13–18.

*Primary Examiner*—Richard K. Seidel

*Attorney, Agent, or Firm*—James M. Rashid

[57] ABSTRACT

According to this invention, the oxidation resistance of alumina scale forming nickel based superalloys is significantly improved by controlling the level of sulfur in the alloy composition. According to one preferred embodiment of the invention, the superalloys contain less than 5 parts per million, by weight, of sulfur. Most preferably, they contain less than 2 parts per million, by weight, of sulfur.

7 Claims, 3 Drawing Sheets

OXIDATION RESISTANT SUPERALLOYS CONTAINING LOW SULFUR LEVELS

TECHNICAL FIELD

This invention relates to cast, oxidation resistant superalloys and methods for making them.

BACKGROUND

Materials used in the high temperature sections of modern gas turbine engines and other similar machines require an optimized combination of mechanical properties and resistance to environmental degradation (oxidation and corrosion) at elevated temperatures. Superalloys, based on nickel, cobalt, or iron, often possess these desired properties, and have found widespread use in industry. The term "superalloy" is used to denote that class of refractory modified metal alloys specifically developed for high temperature service.

The primary reason for the oxidation resistance of components made from superalloys is that they form an oxide scale on the component surface at elevated temperatures; when the scale is adherent, it provides the component with long term protection from oxidation. The oxidation resistance of superalloy components can be further improved by applying an oxidation resistant coating to the component surface. See, e.g., commonly assigned U.S. Pat. Nos. 3,544,348 to Boone et al and 3,928,026 to Hecht et al. The composition and nature of oxide scales depends primarily on the composition of the alloy, and the environment in which the component operates. The important role that oxide scales play in determining high temperature properties has resulted in an extensive amount of study being devoted to their behavior. This study has revealed that several major types of oxide scales exist, which include simple as well as complex oxides/spinels based primarily on aluminum, cobalt, nickel, and chromium.

It is known that when certain ones of the rare earth elements (i.e., those elements with consecutive atomic numbers of 57 to 71, inclusive; also including yttrium, atomic number 39) are intentionally added in closely controlled amounts to some high temperature alloy compositions, the oxidation resistance of components made from such compositions is improved, because the oxide scale which forms on the component surface has greater resistance to spallation during use. See, e.g., U.S. Pat. No. 3,754,902 to Boone et al. A similar effect has also been observed with oxidation and corrosion resistant MCrAl type overlay coatings (where M is nickel, cobalt, iron, or mixtures thereof) which are often applied to the surface of components used in severe environments. Yttrium is typically the most preferred rare earth element added to MCrAl type coating alloys. A general discussion of the effects of rare earth additions on the properties of structural alloys and coating compositions is found in D. P. Whittle and J. Stringer, "Improvement in Properties: Additives in Oxidation Resistance", Philosophical Transactions of the Royal Society of London, Series A, Volume 295, 1980.

One obstacle which has, to date, limited the widespread use of rare earth modified superalloys is the high reactivity of rare earths such as yttrium with the molds and cores used in the investment casting processes. This is especially true in the directional solidification of superalloys, since the rare earths are highly reactive with silica, alumina, and zircon, materials commonly used to make investment casting molds and cores. Furthermore, the relatively slow rate at which solidification proceeds during directional solidification allows much time for the rare earth in the molten metal to react with the mold and core materials. The extent of the reaction which takes place during the casting process is difficult to predict and control, and as a result, the rare earth content in the component often varies from one casting to the next; sometimes, it even varies from one location to another in individual castings. Furthermore, the reaction product is chemically very stable, and it as well as the core are difficult to remove from the casting.

The metallurgy of structural alloys (high temperature alloys and superalloys) and coating alloys represents a sophisticated and well developed field. Much effort has been expended to optimize the composition of these alloys, including the definition of the amounts of elements which are desirably present, and the amounts of elements which are desirably absent. The latter elements are generally considered impurities, and while many elements can be completely eliminated from structural and coating alloy compositions, e.g., through the judicious selection of melt stock material, other elements cannot be entirely eliminated. One impurity which has long been recognized as being detrimental to certain properties is sulfur. Sulfur was initially identified as being detrimental to mechanical properties, and its presence in alloy compositions was limited for that reason. See, e.g., Merica et al, "The Malleability of Nickel", Transactions of the AIME, Volume 71, 1925. More recently, the presence of sulfur has also been identified as degrading oxidation resistance. See, e.g., Ikeda et al, "High Temperature Oxidation and Surface Segregation of Sulfur", Proceedings of the Third Japan Institute of Metals, Volume 24, 1983; and Funkenbusch et al "Reactive Element—Sulfur Interaction and Oxide Scale Adherence", Metallurgical Transactions A, Volume 16A, June 1985.

In view of the undesired effects of sulfur on mechanical properties and oxidation resistance, the sulfur level in high temperature alloys, superalloys, and coatings is typically limited to no more than about 100–300 parts per million by weight (ppmw). In some cases, more strict limits are imposed on the sulfur content. See, e.g., U.S. Pat. No. 3,853,540 to Schlatter et al, which states that the mechanical properties of nickel based alloys are improved by limiting the sulfur content to no more than about 20 parts per million. In U.S. Pat. No. 4,626,408 to Osozawa et al, the hot workability of Inconel Alloy 600 is improved by limiting the sulfur content to no more than about 10 parts per million. In U.S. Pat. No. 4,530,720 to Moroishi et al, the sulfur level in certain iron based alloys is limited to no more than 15 parts per million in order to optimize oxidation resistance.

Several methods for removing sulfur from molten metal exist. Many of these techniques involve contacting the molten metal with a rare earth compound, during which sulfur and the rare earth react to form a rare earth sulfide, and then removing the sulfide from the melt. See, e.g., Cremisio et al, "Sulfur—Its Effects, Removal or Modification in Vacuum Melting", Third International Symposium on Electroslag and Other Special Melting Technology, 1971; and U.S. Pat. Nos. 4,507,149 to Kay; 4,542,116 to Bertolacini et al; 4,385,937 to McGurty; 4,404,946 to Ototani. This article and each of these patents are incorporated by reference. Another technique for making components having low sulfur levels is to use high purity melt stock, and melting and solidifying the molten metal under high purity conditions.

Notwithstanding the advances which result from using materials which contain rare earth additions and/or which contain the low sulfur levels of the prior art, further improvements are needed. Such improvements would, for example, allow superalloy components to be used at higher service temperatures than they are currently used at, and therefore improve the efficiency of gas turbine engines and other types of machines.

SUMMARY OF THE INVENTION

According to this invention, the high temperature oxidation resistance of components made from superalloys which are primarily alumina scale formers is significantly improved when the amount of sulfur present in the component is closely controlled below a critical amount. On a weight percent basis, the sulfur level must be below about 5 parts per million (ppmw); it is most preferably below about 2 ppmw.

The improvements observed when the sulfur level is limited to below 5 ppmw, preferably below 2 ppmw, are related to the effects of sulfur on alumina scales which form on superalloy components at elevated temperatures.

It has been discovered that when the sulfur level in the component is above about 5 ppmw and outside of the invention range, the sulfur diffuses to the alumina scale formed during elevated temperature exposure. Sulfur degrades alumina scale adherence, causing premature spalling from the component surface during high temperature use. Eventually, the component becomes oxidized because the protective alumina scale is unable to reform.

When the sulfur level in the component is maintained below the invention level of about 5 ppmw, exfoliation of the scale is markedly decreased. As a result, the oxidation resistance of components with the invention composition is significantly improved compared to components having the same composition but higher sulfur levels. Tests show that the oxidation resistance of the alumina forming invention alloys is comparable to that of rare earth modified superalloys. And since the invention alloys do not contain intentional additions of reactive rare earth elements like yttrium, they may be cast using conventional investment and directional solidification casting techniques, and there will be no unusual reaction between the molten metal and the casting molds and cores.

Therefore, the key feature of the invention is to limit the amount of sulfur which is available to diffuse to and degrade the adherence of the alumina scale. Besides controlling the amount of sulfur in the component to below 5 ppmw, the advantages of the invention can be achieved in another way: By processing the alloy such that sulfides which are present in components made from the alloy are thermodynamically and kinetically stable at elevated temperatures, so that sulfur is unable to diffuse to the scale and degrade its adherence. Components made in this manner have excellent oxidation resistance without the need for intentional additions of rare earth elements. Alloys of this type are within the scope of this invention if they behave as if they contain less than 5 ppmw sulfur and contain no intentional additions of rare earth elements; they are considered for the purpose of this specification, to have a sulfur activity which corresponds to 5 ppmw. Preferably, they have a sulfur activity which corresponds to 2 ppmw sulfur.

The invention may be better understood by referring to the drawings and description of the Best Mode for Carrying Out the Invention.

BEST MODE FOR CARRYING OUT THE INVENTION

Figure 1:
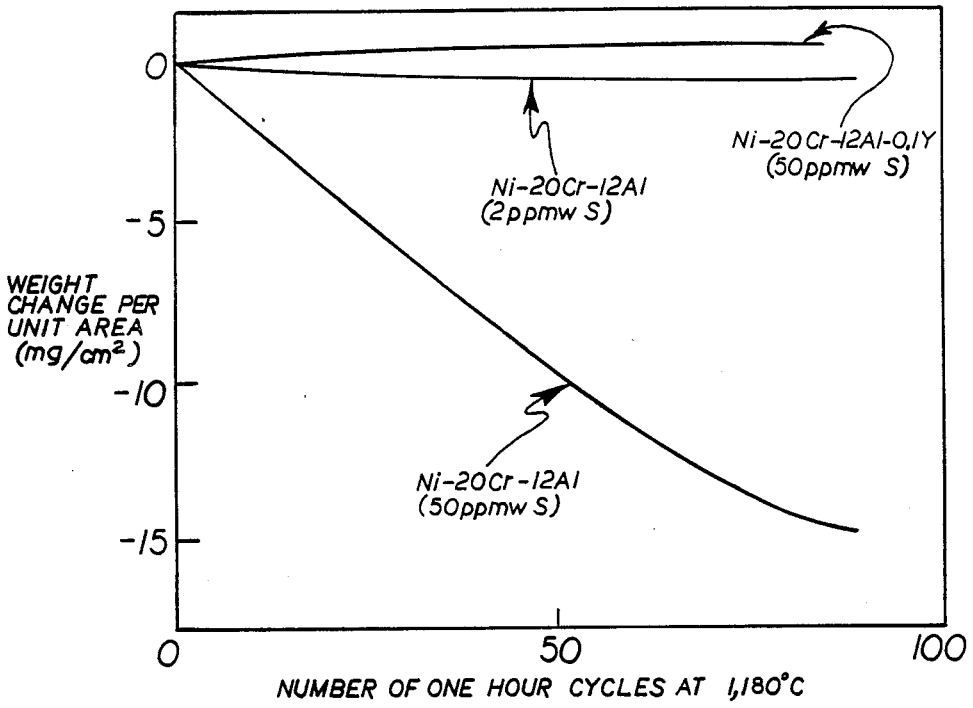
FIG. 1 shows the cyclic oxidation resistance of several NiCrAl alloys at 1,180° C.(2,150° F.).

The preferred techniques for preparing the invention adherent alumina scale-forming superalloy compositions are described in the Background section. These techniques include either contacting the molten metal with a rare earth compound to form a rare earth sulfide slag and then removing the slag from the melt; by melting and solidifying very pure melt stock under high purity conditions, or a combination thereof. Regardless of the method by which the invention superalloy components are made, it is important that accurate techniques be utilized for gauging the level of sulfur in the component. In the examples discussed below, glow discharge mass spectrometry was used to accurately determine sulfur levels in the range of about 0.5 to 50 ppmw. Cyclic oxidation tests were used to characterize the benefits of reduced sulfur activity, although techniques such as high temperature mass spectrometry can also be utilized.

Alumina scale forming nickel base superalloys within the scope of the invention have compositions within the following ranges: 5–15Cr, 3–10Al, 0–15Co, 0–8Mo, 0–12W, 0–5Re, 0–14Ta, 0–5Ti, 0–4Nb, 0–2V, 0–3Hf, 0–0.1Zr, 0–0.3C, 0–0.01B, balance Ni. Superalloys within this range are described in, e.g., U.S. Pat. No. 4,719,080, "Advanced High Strength Single Crystal Superalloy Compositions"; U.S. Pat. No. 4,209,348 to Duhl et al, sometimes referred to as PWA 1480; and the superalloy commercially known as NX-188. Certain superalloys within the range recited above are not alumina formers, and may not significantly benefit from reductions in sulfur. Such superalloys include those commercially known as IN792, IN718, and Waspaloy; the superalloy commercially known as Udimet 500; and U.S. Pat. No. 3,711,337 to Sullivan, sometimes referred to as PWA 1422.

Whether or not a superalloy will be an alumina scale former, and therefore benefit from low sulfur levels of this invention, can be readily determined by the following test: Heat a clean specimen having the composition in question in an oxygen containing atmosphere to a temperature of about 1,000° C. (1,830° F.). After at least about one minute at such temperature, cool the specimen to room temperature and examine the oxide scale which formed on the specimen surface. If the scale is translucent, or if it is opaque and ranges in color from white to light blue to gray, the alloy is an alumina former. If the scale is, for example, dark blue, it is not an alumina former, and will not likely benefit from the low sulfur levels of this invention.

The effects of low sulfur levels on the oxidation resistance of superalloy castings are surprising, and have a substantial potential impact on the gas turbine engine industry. Some engine components such as blades and vanes used in the turbine section are continually exposed to very high service temperatures. At such temperatures, resistance to oxidation can be the life limiting property of these components. The superalloys of this invention, being more resistant to oxidation degradation than currently used superalloys, are better able to withstand use at high temperatures.

A result of the use of this invention is that gas turbine engine blades and vanes, which have internal cavities formed by ceramic cores during the casting process, may be made which have excellent oxidation resistance as well as excellent mechanical properties at elevated temperatures. Because the invention alloys do not require intentional additions of reactive rare earth elements (such as yttrium) to achieve excellent oxidation resistance, the invention alloys are readily cast using conventional techniques.

The invention is best shown by reference to the following Examples. These examples show that the oxidation resistance of nickel base superalloys is best when the sulfur level is below a maximum level of about 5 parts per million by weight. Comparable properties are achieved when the sulfur activity corresponds to a level of about 5 ppmw; no intentional rare earth element additions are required to achieve such properties.

EXAMPLE I

High purity nickel, chromium, and aluminum, each containing no more than about 0.5 ppmw of sulfur, were vacuum cast in high purity alumina crucibles and then poured into copper chill molds. Specimens were also made by arc melting on high purity water cooled copper hearths. All specimens were homogenized at about 1,200° C. (2,200° F.) for about 24 hours in an inert atmosphere. The average composition of each of these specimens was, on a weight percent basis, Ni-20Cr-12Al. The impurity level of sulfur in the castings was determined by glow discharge mass spectrometry to be about 2 ppmw.

Castings having the same nominal Ni-20Cr-12Al composition, but prepared from conventional purity starting materials, were melted and solidified in a similar fashion for comparison oxidation testing. These castings contained about 50 ppmw of sulfur. A third set of castings were also prepared from conventional purity melt stock, and their nominal composition was Ni-20Cr-12Al-0.1Y. They also contained about 50 ppmw S.

All three sets of castings were subjected to cyclic oxidation testing. Each cycle consisted of 55 minutes at about 1,180° C. (2,150° F.), followed by forced air cooling for about 5 minutes. A thin scale formed on the surface of each specimen after the first test cycle. The scale was translucent, thereby indicating that it was alumina, although it is known that alumina scales can also be opaque and range in color from white to light blue to gray. The results of the cyclic oxidation testing are shown in FIG. 1, where weight loss is indicative of scale exfoliation and therefore oxidation. The Figure shows that the oxidation resistance of the low sulfur (2 ppmw) NiCrAl casting was excellent, and comparable to that of the NiCrAlY casting containing conventional (50 ppmw) levels of sulfur. Both specimens (low sulfur and yttrium containing) performed significantly better than the NiCrAl casting which contained conventional (50 ppmw) levels of sulfur. These tests indicate the significant benefit of formulating and using alumina forming alloy compositions which contain very low sulfur levels. These tests also show that by closely controlling the sulfur level, no intentional additions of yttrium need be made to the alloy composition.

EXAMPLE II

Melt stock having a nominal Ni-20Cr-12Al composition, and also containing between about 10–50 ppmw of sulfur was vacuum cast and then poured through a filler cup containing sintered yttrium oxide chips, and then into a convention ceramic casting mold. In cyclic oxidation tests at 1,180° C. (2,150° F.), the oxidation resistance of the yttrium oxide treated NiCrAl specimen was comparable to that of a Ni-20Cr-12Al-0.1Y alloy containing about 50 ppmw S, and a Ni-20Cr-12Al alloy specimen containing about 2 ppmw S.

The amount of sulfur in the yttrium oxide treated specimen was not analytically measured. However, it is believed that on a weight percent basis, the sulfur content in this specimen was greater than about 2 ppmw, and perhaps even greater than 5 ppmw. Some of the yttrium sulfides and/or oxysulfides which formed when the molten metal was poured through the yttrium oxide chips probably passed into the casting mold even though steps were taken to avoid such. The yttrium and sulfur were therefore considered to be unintentionally present in the casting. Since these sulfides and oxysulfides are stable even at elevated temperatures (including the oxidation test temperature), the sulfur could not diffuse to and cause exfoliation of the alumina scale. Likewise, the yttrium could not diffuse to improve the adherence of the alumina scale. In oxidation tests, the specimen behaved as if it contained only 2 ppmw sulfur, even though it likely contained a greater amount. The specimen was therefore considered to have a sulfur activity which corresponded to 2 ppmw, and as noted above, contained no intentional additions of rare earth elements.

This test therefore shows that in addition to measuring the actual level of sulfur in the casting, it is also necessary to determine the activity of sulfur in the casting. Optimum oxidation resistance will be obtained when the specimen actually contains less than about 5 ppmw sulfur, or when the sulfur activity corresponds to a level of 5 ppmw or less. Most preferably, either the sulfur content is less than 2 ppmw, or the sulfur activity corresponds to a level of 2 ppmw or less.

EXAMPLE III

The nickel base superalloy composition described by Duhl et al in U.S. Pat. No. 4,719,080, entitled "Advanced High Strength Single Crystal Superalloy Compositions" was vacuum melted, yttrium oxide treated, and cast in a manner similar to that described in Example II above. The specimens were then homogenized at 1,200° C. for 24 hours. The composition of the castings prepared in this manner was in the range defined by the following limits:

| Element | Weight Percent |
|---|---|
| Cr | 4.0–7.5 |
| Co | 8–12 |
| Mo | 0.5–2.5 |
| W | 3.5–7.5 |
| Re | 2.5–4.0 |
| Ta | 8–10 |
| Al | 5–6 |
| Hf | 0.05–0.15 |
| Ni | balance |

In cyclic oxidation tests performed at 1,180° C. (2,150° F.), alumina scales formed, and were largely adherent for test times up to about 200 cycles. The oxidation resistance of these specimens was comparable to castings having a similar composition but also containing about 0.2% Y and about 50 ppmw S. These tests show the benefits of reducing sulfur activity by yttria treatment of the melt, and that castings containing no intentional additions of yttrium have excellent oxidation resistance when the sulfur activity is low.

EXAMPLE IV

Four sets of nickel base superalloy castings were prepared and evaluated. The nominal composition of these specimens was, on a weight percent basis, as follows: 9Cr-7Al-9.5W-3Ta-1Mo-0.2Hf-balance nickel. The first set of castings were prepared by vacuum melting high purity starting materials (melt stock components each containing less than about 0.5 ppmw S). The second set of castings was prepared by arc melting the same high purity starting materials; the sulfur level in the first and second sets of castings was measured by mass spectrometry glow discharge techniques to be about 2 ppm by weight. The third and fourth sets of castings were vacuum cast from conventional purity materials, and the sulfur levels in these castings were measured as being between about 7–20 ppmw. After casting, all sets of specimens were homogenized by heating at 1,200° C. for 24 hours.

Figure 2:
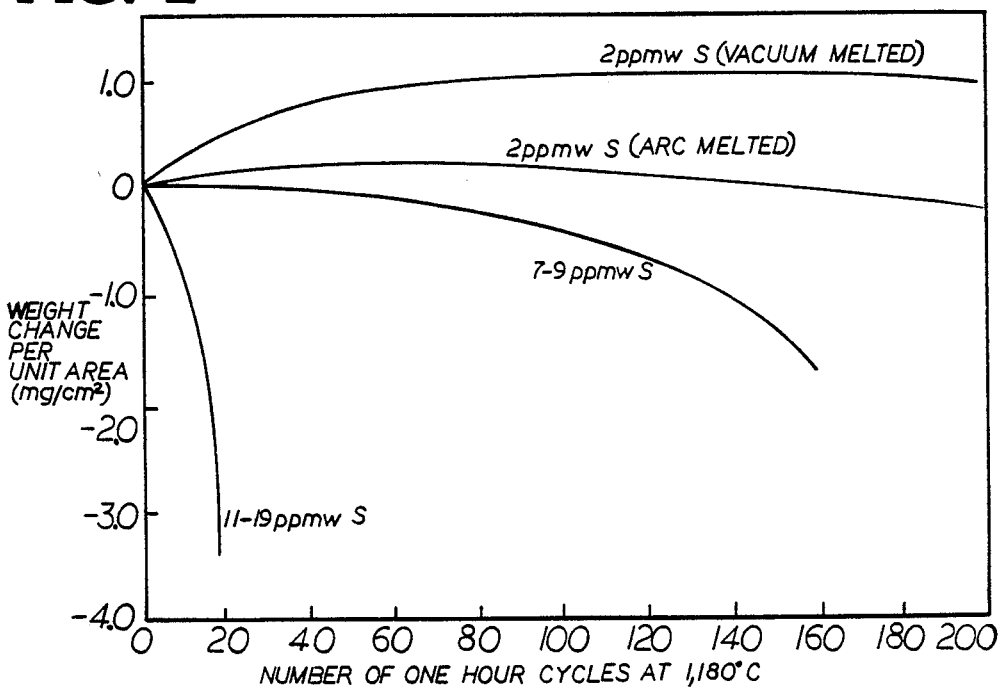
FIGS. 2 and 3 show the cyclic oxidation resistance of several nickel base superalloys at 1,180° C.(2,150° F.).

Oxidation testing at 1,180° C. (2,150° F.) revealed the alloys to be alumina formers. Results of the testing are presented in FIG. 2, which shows the significant and unexpected benefits of reducing the sulfur lever to the 2 ppmw range. The results of this Example indicate that the specimens of Example III had a sulfur activity corresponding to about 2 ppmw.

Even though the oxidation resistance of the conventional purity specimens appears to be poor, the alloy can still be used in gas turbine engines as long as an oxidation resistant coating is applied to the surface of the component, as described in the Background Section.

EXAMPLE V

Three sets of nickel base superalloy castings having the composition described in Example IV were prepared. These specimens were tested in cyclic oxidation at 1,180° C., which showed that the superalloys were alumina forming compositions. One set of castings contained about 11–19 ppm S; a second set of castings contained about 7–9 ppm S; a third set of castings were treated by pouring the molten metal over sintered $Y_2O_3$ chips, as set forth in Example II. In preparing the third set of casting specimens, the weight ratio of $Y_2O_3$ to molten metal was varied from one casting to the next to determine whether this ratio affected the oxidation resistance of the castings which were produced.

Figure 3:
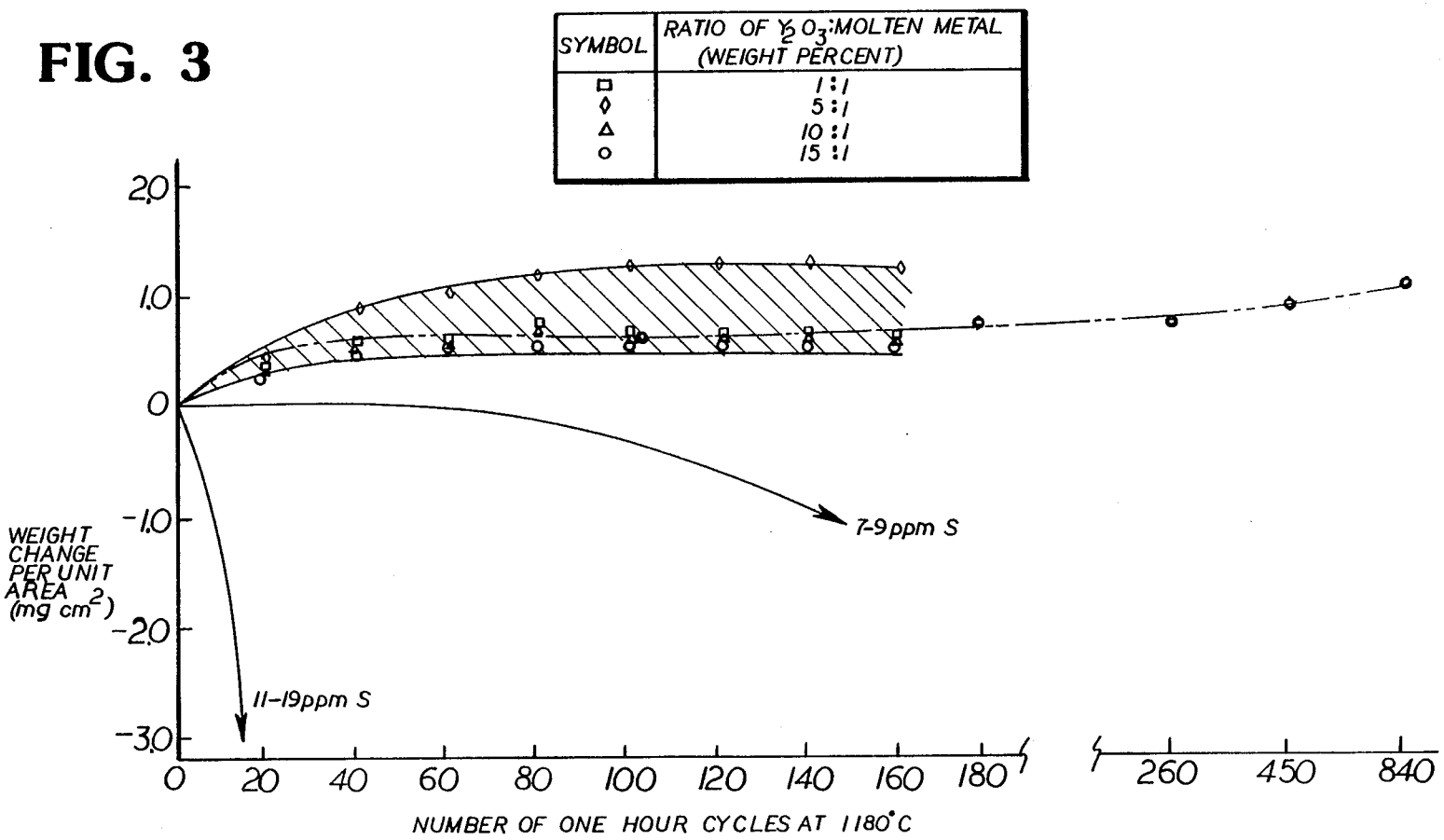

FIG. 3 shows that treatment ratios of 1:1 to 1:5 (weight of $Y_2O_3$ to weight of molten metal) produced castings with excellent oxidation resistance. On the basis of these tests and those reported in the Examples discussed above, the yttrium oxide treated castings were estimated to have a sulfur activity corresponding to about 2 ppm by weight. The oxidation resistance of the specimens which contained 7–9 ppmw sulfur was good, but not considered good enough for long term use at high temperatures. The specimens which contained 11–19 ppmw sulfur are seen to have relatively poor oxidation resistance.

EXAMPLE VI

Castings having the nickel base superalloy composition described in Example III, but containing varying sulfur levels, were prepared and evaluated in cyclic oxidation tests at 1,180° C. The first sample, designated A in the table below, was prepared from conventional purity melt stock and had a measured sulfur level of about 16 ppmw; the second sample, B, was prepared from high purity melt stock, and had a sulfur level estimated to be below at least about 5 ppmw; the third sample, C., was prepared by melting conventional purity elements, and then treating the melt with yttrium oxide in the manner described in Example II; the fourth sample, D, was prepared from conventional purity melt stock and also contained about 0.1 weight percent yttrium. The oxidation test results, presented in terms of milligrams lost per square centimeter of specimen after 250 test cycles, were as follows:

| Sample | Weight Loss ($mg/cm^2$) |
|---|---|
| A | 40 |
| B | 3 |
| C | 2 |
| D | 1 |

These tests show the significant effect of lowering the active sulfur level in the casting, either by making the casting from high purity melt stock, treating the molten alloy with yttrium oxide, or by adding yttrium to the alloy composition. Since B, C, and D performed comparably, and in view of the results presented in the Examples above, the specimens are each considered to have a sulfur activity corresponding to about 2 ppm by weight or less.

Although the invention has been shown and described with respect to a preferred embodiment thereof, it should be understood by those skilled in the art that other various changes and omissions in the form and detail thereof may be made therein without departing from the spirit and scope of the invention.

We claim:

1. A method for making an oxidation resistant blade or vane casting for a gas turbine engine, comprising the steps of melting a nickel base superalloy composition selected from the group of compositions which form an alumina scale on the casting surface at elevated temperatures; contacting the molten superalloy with a rare earth compound to form rare earth sulfides; removing said sulfides; and solidifying the molten superalloy to form the metal casting, wherein said removing step is conducted such that the sulfur level in the solidified casting is no more than about 5 parts per million by weight, whereby the casting has improved oxidation resistance.

2. The method of claim 1, wherein said removing step is conducted such that the sulfur level in the casting is no more than 2 parts per million by weight.

3. A method for making an oxidation resistant nickel base superalloy casting, comprising the steps of melting an alumina scale forming composition which consists essentially of, by weight percent, 5–15Cr, 3–10Al, 0–15Co, 0–8Mo, 0–14Ta, 0–5Ti, 0–4Nb, 0–3Hf, 0–2V, 0–0.1Zr, 0–0.3C, 0–0.1B, balance nickel; contacting the molten superalloy with a rare earth compound to form rare earth containing sulfides; removing said sulfides;

and solidifying the molten superalloy under conditions which result in a casting containing no intentional additions of rare earth elements, and having a sulfur activity which corresponds to the activity in the same composition which contains no more than about 5 parts per million by weight.

4. The method of claim 3, wherein the rare earth compound is yttrium oxide.

5. The method of claim 3, wherein the molten superalloy is directionally solidified to make a casting having a columnar grain or single crystal microstructure.

6. The method of claim 5, wherein the molten superalloy is directionally solidified using investment casting techniques, and the casting has an internal cavity formed by the steps which include pouring the molten superalloy into a mold which contains a ceramic core, solidifying the superalloy around the core within the mold, and then removing the core from the casting to make a hollow casting.

7. The method of claim 3, further comprising the step of removing the rare earth sulfides from the molten superalloy prior to said step of solidifying the superalloy.

* * * * *

UNITED STATES PATENT AND TRADEMARK OFFICE

CERTIFICATE OF CORRECTION

PATENT NO. : 4,895,201

DATED : January 23, 1990

INVENTOR(S) : Michael DeCrescente et al.

It is certified that error appears in the above-identified patent and that said Letters Patent is hereby corrected as shown below:

In CLAIM 3:

On line 65 between "0-8Mo," and "0-14Ta," insert:

-- 0-12W, 0-5 Re, --

Signed and Sealed this

Nineteenth Day of November, 1991

*Attest:*

HARRY F. MANBECK, JR.

*Attesting Officer*

*Commissioner of Patents and Trademarks*